United States Patent [19]

Hanyu

[11] 4,399,762

[45] Aug. 23, 1983

[54] SEWING MACHINE HOUSING STRUCTURE

[75] Inventor: Susumu Hanyu, Hachioji, Japan

[73] Assignee: Janome Sewing Machine Co. Ltd., Tokyo, Japan

[21] Appl. No.: 284,447

[22] Filed: Jul. 17, 1981

[30] Foreign Application Priority Data

Jul. 21, 1980 [JP] Japan ..... 55-98670

[51] Int. Cl.[3] ..... D05B 73/00

[52] U.S. Cl. ..... 112/259

[58] Field of Search ..... 112/258, 259

[56] References Cited

U.S. PATENT DOCUMENTS 2,724,355 11/1955 Heimann ..... 112/258

4,333,410 6/1982 Taketomi ..... 112/259 X

FOREIGN PATENT DOCUMENTS 2312587 5/1973 France ..... 112/259

6704437 9/1968 Netherlands ..... 112/258

*Primary Examiner*—Werner H. Schroeder

*Assistant Examiner*—Andrew M. Falik

*Attorney, Agent, or Firm*—Michael J. Striker

[57] ABSTRACT

The machine housing of a sewing machine is divided into a bed part provided with a hollow standard and an arm part which overhangs the flat horizontal face of the machine bed part. The machine arm part is connected to the upper end of the standard by a number of fastening bolts. A reamer bolt is first inserted into the upper end of the standard through the bottom of the bed part to provisionally connect the arm part to the standard, and then an eccentric pin inserted into respective bores provided in both parts of the housing is rotated to turn the machine arm part around the reamer bolt with respect to the machine bed part. After the arm part has been adjusted with the flat face of the bed part both parts are fastened to each other by fastening bolts.

4 Claims, 8 Drawing Figures

SEWING MACHINE HOUSING STRUCTURE

BACKGROUND OF THE INVENTION

The invention relates to a sewing machine, and more particularly it relates to a housing structure of the sewing machine. Generally a machine housing is divided into two parts for assembling the components of the sewing machine. It has therefore been a problem how to effectively and rapidly connect the two parts of the machine housing with a required precision during a mass-production of sewing machines.

In the conventional sewing machines, the machine housing is, as shown in FIG. 1, composed of a machine arm 1 including a vertical hollow standard 1*a* and a machine bed 2 with an upper flat face 3. Therefore the machine arm 1 has a juncture edge 4 provided at the lower end of the standard, and the machine bed 2 has a juncture part 4*a* provided at the upper edge thereof. The connecting operation of the two structures 1, 2 is required at the lower level of the machine housing. The two structures 1, 2 are adjustedly connected to each other by a number of threaded bolts 5, and a number of pins 6 are employed for positional adustment of the structures 1, 2. The connecting operation is to be implemented at the bottom of the machine bed 2 when the machine housing is put in the horizontal position. With such a bulky and heavy machine housing, it is very burdensome to implement the connecting operation in such a manner. Moreover it is very difficult to positionally adjust the arm 1 with respect to the machine bed 2 or vice versa so that the needle supported in the bracket 10 of the arm 1 may be precisely aligned with the needle drop hole 9 of the needle plate 8 carried on the upper flat face 3 of the machine bed 2. It may be said that all such difficulties in the connecting operation result from the fact that the juncture parts 4, 4*a* are far from the bracket 10 of the machine arm 1.

On the other hand, according to the conventional machine in which housing structure 11 as shown in FIG. 2 which is not divided into two parts, but made up as an integral one, it becomes necessary to mount the components of the sewing machine with a severe precision. for example, the needle bar with the needle has to be mounted to the bracket of the machine arm with a precision, so that the needle may be precisely aligned with the needle drop hole of the needle plate. Such a precision is required with respect to so many locations of mechanisms of the sewing machine.

SUMMARY OF THE INVENTION

The present invention has been provided to eliminate the defects and disadvantages of the prior art. It is an object of the invention to provide a machine housing structure of a sewing machine which may be effectively and rapidly assembled with a precision of the components of sewing machine. For attaining the object, according the invention, the machine housing is divided into two parts; one part is a machine bed part including an upper flat face carrying a needle plate and a hollow standard projected from the flat face, and the other part is a machine arm part which is opened at the top thereof and is extended from the upper end of the standard and overhangs the flat face of the machine bed part and terminates in a bracket for supporting a needle bar with a needle which is vertically reciprocated into and out of the needle drop hole of the needle plate. Thus, in the invention, the machine arm part is connected to the juncture edge at the upper end of the standard by a number of fastening bolts. Especially a reamer bolt and an eccentric element are employed to connect the machine housing parts to each other. The reamer bolt initially and provisionally connects the machine arm part to the standard, and then the eccentric element is rotated to turn the machine arm part around the reamer bolt with respect to the machine bed part, so that the needle may be properly aligned with the needle drop hole of the needle plate. Such a connecting operation is implemented in the opening at the top of the machine arm part. Since the juncture edges of the machine arm part and the machine bed part are considerably close to the bracket of the machine arm part supporting the needle bar with the needle, the connecting operation is implemented very effectively and rapidly in the course of mass-production of sewing machines.

DETAILED DESCRIPTION OF THE PREFERRED EMBODIMENTS

Figure 1:
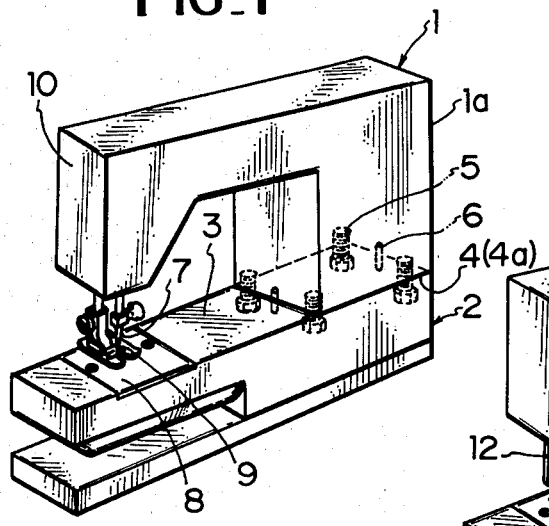
FIGS. 1 and 2 are perspective views showing the conventional housing structures of sewing machines.
Figure 2:
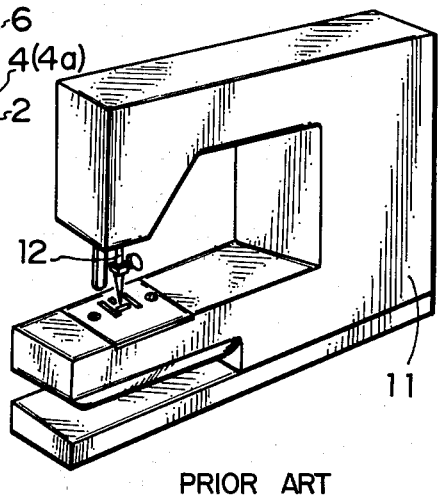
PRIOR ART FIG 2
Figure 3:
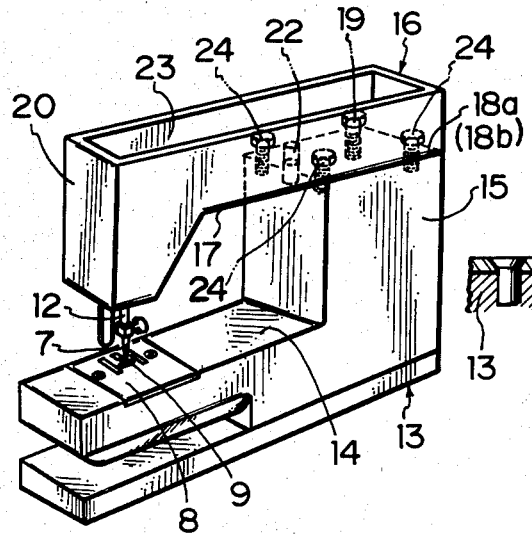
PRIOR ART FIG 3
FIG. 3 is a perspective view showing a housing structure of the sewing machine according to the invention.

With reference to FIG. 3, a sewing machine housing structure is composed of a machine bed part 13 and a machine arm part 16 each formed up separately. The machine bed part 13 has a flat face 14 provided thereon on which a fabric to be sewn is treated and a hollow standard 15 extended therefrom for housing therein the components of a sewing machine. The standard 15 has an upper end processed by a machine tool to provide a juncture edge 18*a* therearound to be connected to a juncture edge 16B of the arm part 16. The machine arm part 16, which is to be connected at one end to the upper end 18*a* of the standard 15 and is to overhang the flat face 14 of the machine bed part 13, is opened at the top 23 thereof and terminates in a bracket 20 at the other end thereof. The machine arm 16 is at the one end partly opened at the bottom thereof and provides the juncture edge 18*b* around the bottom opening, which is processed by a machine tool so as to be connected to the juncture edge 18*a* of the standard 15.

Figure 5:
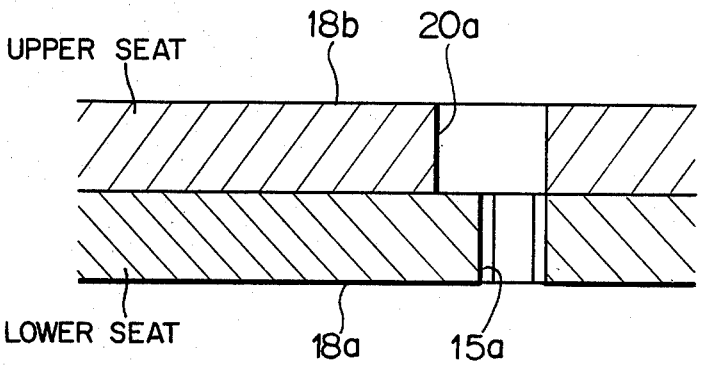
FIGS. 5 and 6 show in a sectional view and in a top plan view, respectively, a pair of adjusting bores provided in the parts of the machine housing to be connected to each other.
Figure 6:
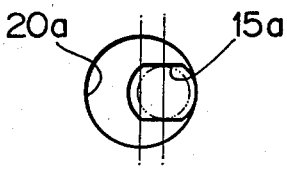
Figure 8:
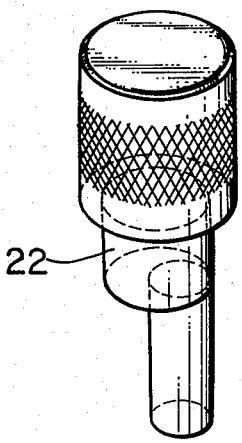
FIGS. 7 and 8 show perspective views of two modifications of eccentric pins employed for connecting the housing parts to each other.
Figure 7:
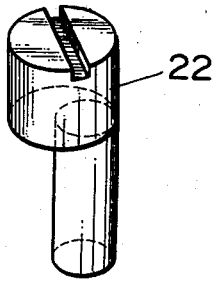

A predetermined number of threaded bolts 19, 24 are used to connect the machine arm part 16 to the machine bed part 13. The same number of seats, though they are not shown, are provided on the inner side of the juncture edge 18*a* of the standard 15 and on the inner side of the juncture edge 18*b* of the machine arm 16. These upper and lower seats are each in pairs and in alignment with each other. The upper seats on the inner side of the juncture edge 18*b* of the machine arm part 16 are each formed with a vertical bore therethrough, and the lower seats on the inner side of the juncture edge 18*a* of the standard 15 are each formed with a vertical threaded bore. Additionally a pair of adjusting bores 20*a*, 15*b* shown in FIGS. 5 and 6 are provided to be in alignment with each other in the vertical direction, one being provided in an upper seat (not shown) formed on the inner side of the juncture edge 18*b* of the machine arm part 16 and the other being provided in a lower seat formed on the inner side of the juncture edge 18*a* of the standard 15. An eccentric pin 22 shown in FIGS. 7 and 8 is inserted into the pair of adjusting bores.

Figure 4:
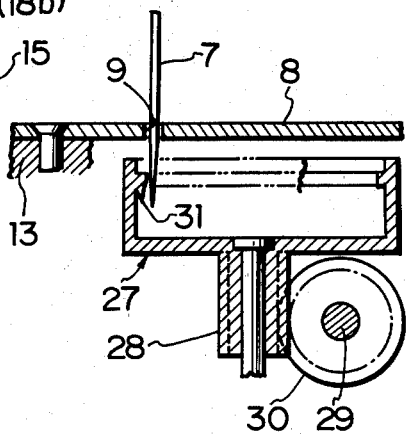
FIG. 4 is a front elevational view, partly in section, showing a normal relation between the components of the sewing machine contained in the housing structure thereof.

FIG. 4 shows a normal relation between a needle 7 secured to the lower end of a needle bar supported in the bracket 20 of the machine arm part 16, a needle drop hole 9 of a needle plate 8 secured to the flat face 14 of the machine bed part 13 and a hook 31 of a loop taker 27 of a horizontal type having a worm 28 which is in engagement with another worm 30 secured to a lower shaft 29.

According to the invention, one of the threaded bolts, i.e. the bolt 19 is a reamer bolt, and one of the bores on the inner side of the juncture edge 18*b* of the machine arm part 16 is a reamer bore, into which the reamer bolt 19 is inserted to positionally adjust therearound the machine arm part 16 with respect to the machine bed part 13.

The structure connecting operation is as follows; Firstly the needle 7 is secured to the needle bar supported in the bracket 20, the needle plate 8 is secured in the predetermined position on the flat face 14 of the machine bed part 13 and the loop taker 27 is mounted in the predetermined position in the machine bed part 13 as shown in FIG. 4.

Then the reamer bolt 19 is inserted into one of the paired bores, of which the upper bore is the reamer bore as aforementioned provided on the inner side of the juncture edge 18*b* of the machine arm part 16. The reamer bolt 19 is provisionally screwed halfway into the lower threaded bore at the juncture edge 18*a* of the standard 15.

Then the eccentric pin 22 inserted into the pair of adjusting bores 20*a*, 15*a* is rotated by means of a driver to positionally adjust the machine arm part 16 around the reamer pin 19 with respect to the machine bed part 13. It is to be noted that the machine arm part 13 and the machine bed part 16 are so precisely formed up as to establish an approximate positional relation between the needle 7 and the needle drop hole 9 when the machine arm part 16 is positioned with respect to the machine bed part 13 by the eccentric pin 22 and the reamer bolt 19. It is therefore necessary to implement a fine adjustment of the machine arm part 16 around the reamer bolt 19 with respect to the machine bed part 13 by rotating the eccentric pin 22 in the adjusting bores while the needle 7 is dropped into the needle drop hole 9 of the needle plate 8, so as to properly align the needle 7 with the needle drop hole 9.

When the fine adjustment of the machine arm part 16 with respect to the machine bed part 13 is obtained, the reamer bolt 19 and the other fastening bolts 24 are completely screwed into the respective threaded bores of the juncture edge 18*a* of the standard 15 to fixedly connect the machine arm part 16 to the machine bed part 13. Such a structure-connecting operation is easily implemented in the opening at the top 23 of the machine arm part 16. Furthermore, it is possible to fixedly connect the machine arm part 16 to the machine bed part 13 by applying a binding aent to the juncture edges 18*a*, 18*b* of the machine housing parts 13, 16, respectively.

I claim:

1. A housing structure of a sewing machine, comprising a machine bed part including a flat face carrying thereon a needle plate with a needle drop hole and a hollow standard projected upwardly from said flat face, said standard having an upper end formed with a first juncture edge provided therearound of the upper end; a machine arm part adapted to be connected to the machine bed part, said machine arm part being horizontally extended from the upper end of the standard and overhanging said flat face of the machine bed part, said arm part terminating with a bracket for supporting a needle which is vertically reciprocated into and out of the needle drop hole of the needle plate in operation of the sewing machine, said machine arm part having a bottom formed with an opening provided at a part of said bottom, said machine arm part being further formed with a second juncture edge provided around said opening, said second juncture edge being oppositely arranged against said first juncture edge in assembly; first fastening means initially screwed halfway into the first juncture edge through the second juncture edge and allowing the machine arm part to be turned therearound; adjusting means including an eccentric element to be inserted into the first and second juncture edges, said eccentric element being rotated to turn the machine arm part about the first fastening means with respect to the machine bed part to positionally adjust the machine arm part with respect to the machine bed part; and a plurality of second fastening means each threaded into the first juncture edge after the machine arm part has been positionally adjusted with respect to the machine bed part by rotation of the eccentric element.

2. A housing structure as defined in claim 1, wherein said first fastening means includes a reamer bolt partly threaded therearound, a reamer bore provided in the second juncture edge and a threaded bore provided in the first juncture edge.

3. A housing structure as defined in claim 1, wherein said adjusting means further includes a pair of bores oppositely provided in the first and second juncture edges respectively for receiving the eccentric element.

4. A housing structure as defined in claim 1, wherein said machine arm part has an opening provided at the top thereof so as to make access to the fastening means and the adjusting means through the opening.

* * * * *